United States Patent [19]

Bockwinkel

[11] Patent Number: 4,741,127

[45] Date of Patent: May 3, 1988

[54] REFRIGERATOR DOOR WITH THERMAL INSULATED OUTER FRAME

[75] Inventor: Gerald J. Bockwinkel, Mundelein, Ill.

[73] Assignee: Ardco Inc., Chicago, Ill.

[21] Appl. No.: 945,031

[22] Filed: Dec. 22, 1986

[51] Int. Cl.[4] ..... E06B 3/00

[52] U.S. Cl. ..... 49/501; 49/DIG. 1; 52/790; 312/296

[58] Field of Search ..... 49/501, DIG. 1; 52/788, 52/789, 790; 312/296

[56] References Cited

U.S. PATENT DOCUMENTS

| | | | |
|---|---|---|---|
| 3,411,247 | 11/1968 | Fleming | 49/501 |
| 3,732,646 | 5/1973 | Horvay et al. | 49/501 X |
| 3,965,638 | 6/1976 | Newman | 49/501 X |
| 4,042,736 | 8/1977 | Flint | 52/790 X |
| 4,145,844 | 3/1979 | Kaspar | 49/501 X |
| 4,149,348 | 4/1979 | Pyzewski | 52/790 X |
| 4,496,201 | 1/1985 | Allgeyer | 49/501 X |

*Primary Examiner*—Philip C. Kannan
*Attorney, Agent, or Firm*—Leydig, Voit & Mayer

[57] ABSTRACT

A refrigerator door assembly comprising a plurality of insulated glass doors mounted in a cabinet frame for relative movement. The glass doors each includes an insulated glass unit having a plurality of glass panes disposed in side-by-side relation, a metal spacer interposed between adjacent of the panes for maintaining the panes in parallel relation with an air space therebetween, and a sealant about the periphery of the spacer for sealing the air space from the outside environment. An outer metal frame is disposed about the periphery of the glass unit, and rigid, non-metallic barrier members are interposed between the outer metal frame and the glass unit for retaining the glass unit within the outer metal frame and for forming a thermal insulating barrier between the outer metal frame and the glass unit and between the outer metal frame and the cabinet frame.

24 Claims, 1 Drawing Sheet

REFRIGERATOR DOOR WITH THERMAL INSULATED OUTER FRAME

DESCRIPTION OF THE INVENTION

Figure 1:
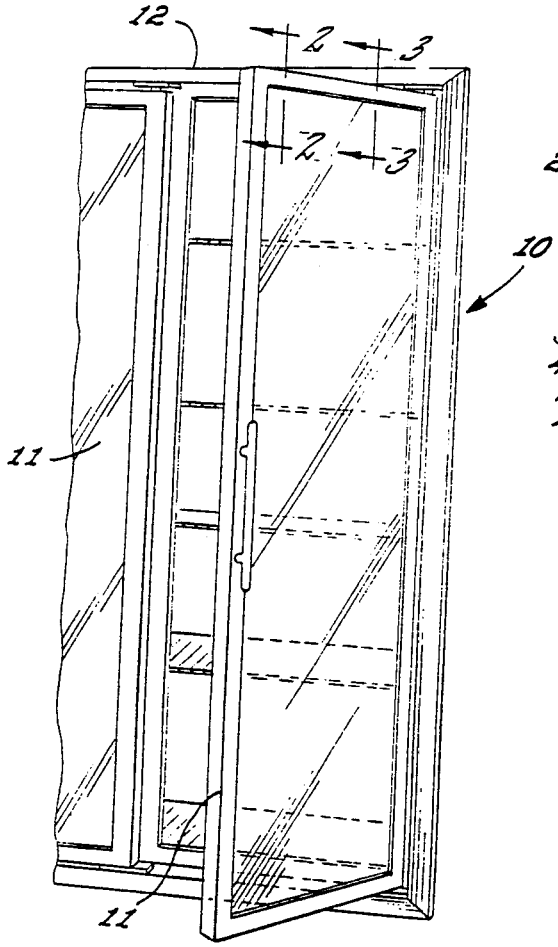

The present invention relates generally to refrigerator doors, and more particularly, to insulated multipane glass door assemblies such as used in commercial refrigeration and freezer units.

Insulated glass doors in commercial refrigeration and freezer units typically comprise an insulated glass unit comprising two or more glass panes that are supported in spaced apart relation with the interior between the panes appropriately sealed. The spacing between the glass panes generally is maintained by tubular metal spacers disposed between the panes about the outer periphery thereof. To provide a finished appearance for the door and facilitate mounting thereof, it is customary to provide an outer metal frame about the perimeter of the insulated glass unit. Since the outer metal frame generally has a finished and decorative appearance and a specifically configured form, the outer frame is relatively expensive to manufacture and often difficult to assemble on the glass unit with proper squareness. Being made of metal, the outer frame also is highly heat conductive.

Indeed, if preventative measures are not taken, the outer metal frame of such refrigerator and freezer doors frequently will cool to a temperature below the dew point of the ambient air, resulting in the undesirable accumulation of condensation and/or frost on the surface of the frame. Such condensation build up in commercial refrigerator doors is undesirable since it can creat a puddle below the door which is a safety hazard. It also detracts from the appearance of the door and graphically shows the waste of energy.

To prevent condensation and frost from forming on the outer metal frame, it has been the practice to include internal electrical resistance heating wires within the frame for adding heat to maintain the portion of the outer metal frame exposed to warmer ambient air at a temperature above the dew point of the ambient air. Such electrical heating means not only adds to the manufacturing cost of the door, but increases the operating cost of the refrigeration unit with which the door is used. While considerable efforts have been made to insulate the outer metal door frames to combat such condensation build up and minimize heating requirements, these efforts in general have not been sufficient to permit complete elimination of electrical heating means in the outer frame of most commercial refrigerator and freezer doors.

It is an object of the present invention to provide an insulated glass door which has improved thermal efficiency and which is of relatively simple and economical construction.

Another object is to provide an insulated glass door as characterized above which can be effectively used in most refrigerator and freezer units without the necessity for electrically heating the outer metal frame of the door.

A further object is to provide an insulated glass door of the above kind that has a non-metallic thermal insulating barrier means which completely isolates the outer metal frame from the glass unit and which cooperates with the outer metal frame to positively retain the glass unit within the outer metal frame.

Figure 2:
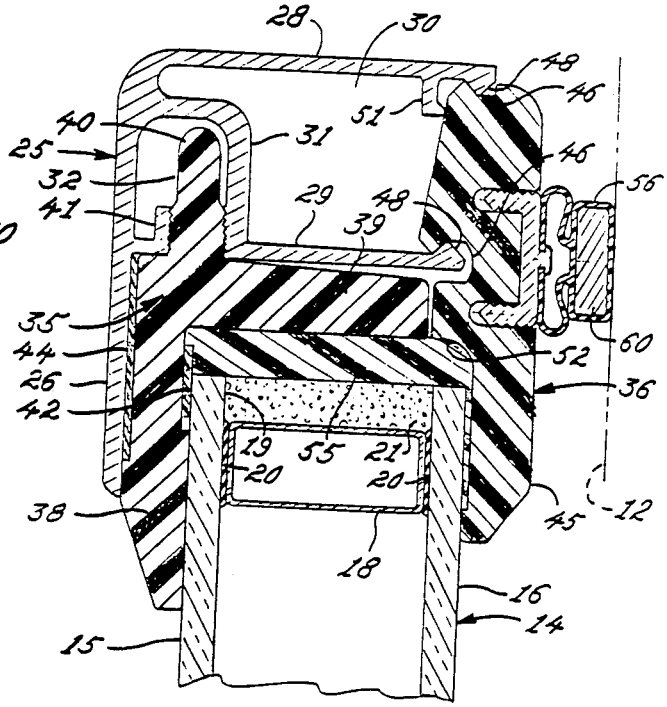
Figure 3:
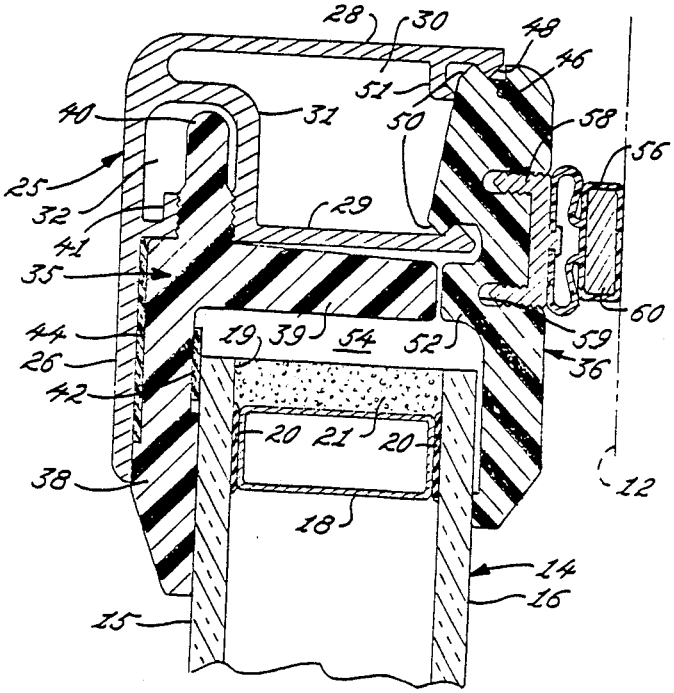

Other objects and advantages of the invention will become apparent upon reading the following detailed description and upon reference to the drawings, in which:

FIG. 1 is a perspective of a refrigerator door assembly having a plurality of hingedly mounted insulated glass doors embodying the present invention; and FIGS. 2 and 3 are enlarged fragmentary sections of one of the doors taken in the planes of lines 2—2 and 3—3, respectively, in FIG. 1.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to FIG. 1 of the drawings, there is shown an illustrative refrigerator door assembly 10 comprising a plurality of insulated glass doors 11 mounted for swinging movement in a cabinet frame 12. The cabinet frame 12 may be of a conventional construction, which typically is mounted within the opening of a front wall of a refrigerator or freezer cabinet. It will be understood that the door assembly 10 is particularly adapted for use in free standing refrigerator cases or built in coolers or cabinets of the type used in supermarkets and other retail stores to display merchandise that requires refrigeration.

The insulated glass doors 11 each include an insulated glass unit 14 comprising a plurality of glass panes 15, 16, disposed in parallel side-by-side relation with the adjacent panes being separated by a spacer 18. The illustrated glass unit 14 includes a pair of panes, the pane 16 being disposed on the inner or refrigerated side of the door and the pane 15 being disposed on the front or ambient air side of the door. As is known in the art, the spacer 18 may comprise a plurality of elongated metal tubular members disposed in a rectangular arrangement between the panes 15, 16, in this instance each being spaced inwardly a small distance from the peripheral edges of the glass panes so as to define an outwardly opening shallow depth channel area 19 about the perimeter of the glass unit 14. The abutting ends of the tubular spacers members may be jointed together by appropriate corner key elements, as is known in the art. A sealant 20, such as polyisolbutylene, is provided between the sides of the spacer 18 and the adjacent glass panes 15, 16 for establishing a primary vapor seal. A layer 21 of a flexible sealant, such as polysulfide, fills the channel area 19 about the outer periphery of the spacer 18. It will be understood that while the illustrated glass unit 14 has been shown with two glass panes 15, 16, alternatively, the glass unit could be made with three or more panes, as is known in the art.

For supporting the glass unit 14 and providing a decorative finished trim about the outer perimeter thereof, each door 11 has an metal outer frame 25, preferably assembled from a plurality of extrusions made of aluminum or other suitable metal and which each are disposed along a respective peripheral side of the glass unit 14. The outer metal frame 25 has a front wall 26, an outer side wall 28, and an inner side wall 29. The outer and inner side walls 28, 29 define a rearwardly opening channel space 30. The inner wall 29 in this instance is formed with an outwardly directed corner portion 31 which together with the front wall 26 defines an inwardly opening channel space 32 closely adjacent the inside of the front wall 26. As will be understood by one skilled in the art, the individual extrusions or members making up the outer metal frame 25 may be coupled together at adjoining corners by corner key members of a conventional type, with the legs of the corner key members forcefully positioned within the channel space 30 defined between the outer and inner side walls 28, 29. As known in the art, the corner key elements on the pivot axis side of the door may be provided with appropriate hinge pins which cooperate with the cabinet frame 12 for supporting the door 11 for swinging movement relative to the cabinet frame 12.

In accordance with the invention, thermal insulating barrier means is interposed between the outer metal frame and the insulated glass unit for retaining the glass unit within the outer metal frame and for forming a thermal barrier between the outer metal frame and the glass unit and between the outer metal frame and the cabinet frame within which the door is mounted. In the illustrated embodiment, the thermal insulated barrier means comprises a pair of rigid, non-metallic barrier members 35, 36 disposed in adjacent side-by-side relation. The thermal insulating barrier members 35, 36 preferably are molded, expanded, or extruded of a plastic foam material, such as structural foam. As is known in the art, such structural foam may be formed with a solid, non-porous skin and a low density closed cell core so as to combine high strength with light weight. It will be appreciated that the barrier members 35, 36 may be molded, expanded, or extruded in linear lengths, then cut to the lengths of the respective sides of the outer metal frame 28. While a pair of barrier members 35, 36 have been shown in the illustrated embodiment to facilitate assembly of the door as will become apparent, alternatively, the barrier members could be formed as a unitary part.

The barrier member 35 on the front side of the door includes a front leg 38 disposed in abutting relation against the outer face of the front glass pane 15 and a side leg 39 which extends rearwardly therefrom in spaced relation to the outer periphery of the insulated glass unit 14. The barrier member 35 further includes an outwardly extending leg 40 that is positionable into the inwardly opening channel space 32 of the outer metal frame 25. For positively securing the outer metal frame 25 to the thermal barrier member 35, a flange 41 extends rearwardly of the front wall 26 of the metal frame 25 for defining a predetermined sized opening to the channel space 32 so that outwardly extending leg 40 of the barrier member 35 can be press fit into the opening. A double backed adhesive tape 42, preferably of a foam type, is provided between the front pane 15 and the front leg 38 of the inner barrier member 35, and a strip 44 of similar tape is provided between the front leg 38 of the barrier member 35 and the front wall 26 of the outer metal frame 25.

For captively retaining the glass unit 14 between the thermal barrier members 35, 36 without the necessity for auxiliary fastening members, the rearwardly located barrier member 36 is releasably engagable with the outer metal frame 25 and is formed with a depending leg 45 that engages the outer surface of the rear pane 16. To releasably connect the rear barrier member 36 to the outer metal frame 25, the forwardly facing side of the barrier member 36 is formed with notches 46 which cooperate with flanges 48 formed on the terminal rearwardly extending ends of the side wall members 28, 29. The flanges 48 are beveled for cooperating with beveled shoulders 50 formed on the forwardly directed face of the barrier member 36 such that upon forceful positioning of the barrier member shoulders 50 against the side wall flanges 48, the side walls 28, 29 are urged apart from each other until the flanges 48 snap into locked position in the notches 46. For limiting forward positioning of the rear barrier member 36 in such locked position, a flange 51 depends from the underside of the outer side wall 28 which is engaged by the barrier member 36. The barrier member 36 is further formed with a forwardly directed side wall portion 52 which abuts in closely adjacent relation to the side wall 39 of the front barrier member 35 for defining an air space 54 (FIG. 3) about the outer periphery of the glass unit 14.

To enhance firm support of the glass unit 14 within the barrier members 35, 36, a hot melt adhesive 55 (FIG. 2) is provided at selected locations in the space 54 between the barrier member 35, 36 and the outer periphery of the glass unit. Such hot melt adhesive 55, for example, may be provided at the corners of the glass unit 14 and at one or more locations along the sides of the glass unit.

For providing a seal between the door 11 and the cabinet frame 12 when the door is in a closed position, a gasket or sealing strip 56 may be secured to the rear side of the barrier member 36. The illustrated sealing strip 56 is affixed to a channel shaped retainer 58 which has forewardly directed legs press fit into slots 59 in the barrier member 36 (FIG. 3). The sealing strip 56 preferably contains magnets 60 for creating a magnetic attraction with the cabinet frame 12 so as to provide a firm sealing pressure between the gasket and the cabinet frame.

Since the barrier members 35, 36 have a cellular core, and thus, relatively low heat conductivity, the barrier members effectively isolate the outer metal frame 25 from the insulated glass unit 14 and from the cabinet frame 12 so that the outer metal frame 12 is exposed primarily to the ambient conditions of the room. The barrier members 35, 36 essentially create a thermal break in the heat path between the outer metal frame 25 and the metal spacer 18 of the glass unit and between the outer frame 25 and the cabinet frame 12. Because of the thermal insulating qualities of the barrier members 35, 36 and their assembled relationship with the outer metal frame 12, under most conditions the outer metal frame 25 will remain at temperatures above the dew point of the ambient air, and thus, be free of condensation and frost build up, without the necessity for electrically heating the outer metal frame.

The barrier members 35, 36, furthermore, facilitate quick and relatively simple assembly of the glass unit 14 within the outer metal frame 25. After applying the adhesive strips 42, 44 to the front barrier member 35, it may be readily assembled on the outer metal frame 25 by positioning of the outwardly extending leg 40 in the channel 32. The insulated glass unit 14 with hot melt 52 provided at selected locations about its periphery may then be positioned into the assembled relation with the barrier member 35 and the outer frame 25 with the adhesive strip 42 engaging a side of the glass unit 14. The rear barrier member 36 may then simply be snapped onto the outer metal frame 36, causing the glass unit 14 to be positively held between the barrier member legs 38, 45.

From the foregoing, therefore, it can be seen that the insulated glass door of the present invention has both improved thermal efficiency and lends itself to relatively simple and economical manufacture. The glass door can be effectively used in most refrigeration and freezer applications without the necessity for electrically heating the outer metal frame, as conventionally required for condensation and frost control. The rigid non-metallic thermal insulating barrier means not only improves the thermal efficiency of the door, but adds to the structural integrity of the door assembly.

I claim as my invention:

1. An insulated door comprising a glass unit having a plurality of glass panes disposed in side-by-side relation, a spacer interposed between adjacent of said panes for maintaining said panes in parallel relation with an air space therebetween, and means sealing said air space from the outer side environment, an outer metal frame member about the periphery of said glass unit for supporting the weight of said glass unit, means formed of rigid non-metallic material interposed between the outer metal frame member and said insulated glass unit for retaining the glass unit within the outer metal frame member and for forming a thermal insulating barrier therebetween, and said retaining and barrier means including a pair of barrier members disposed adjacent the outer periphery of said glass unit, each said barrier member having a leg portion disposed on a respective side of said glass unit, and said barrier members each being engagable with said outer metal frame member for positively retaining said glass unit between said leg portions.

2. The insulated door of claim 1 in which one of said barrier members includes means adapted for snap action positive engagement with said outer metal frame member.

3. The insulated door of claim 1 in which said outer metal frame member has a front wall disposed adjacent a front side of said glass unit and outer and inner side walls which extend rearwardly of said front wall for defining a rearwardly opening channel, and one of said barrier members is positively engagable in said channel.

4. The insulated door of claim 3 in which one of said barrier means members is formed with recesses for receiving and positively retaining the terminal ends of said rearwardly extending side wall.

5. The insulated door of claim 4 in which said rearwardly extending side walls are adapted for snap action engagement in said barrier member recesses.

6. The insulated door of claim 1 in which said retaining and barrier means defines an air space about the outer periphery of said glass unit.

7. The insulated door of claim 6 including a hot melt adhesive at selected locations in said air space for stabilizing the support of said glass unit within said outer metal frame.

8. The insulated door of claim 1 in which said barrier members disposed in side-by-side relation.

9. The insulated door of claim 8 in which at least one of said barrier members is adapted for snap action engagement with said outer metal frame.

10. The insulated door of claim 8 in which one of said barrier members is mounted adjacent a front 11. The insulated door of claim 10 in which the barrier member mounted adjacent a rear side of said door is adapted for snap action engagement with said outer metal frame member.

12. The insulated door of claim 10 including a flexible sealing gasket mounted on a rearwardly exposed side of the barrier member mounted adjacent a rear side of said glass unit.

13. The insulated door of claim 8 in which the barrier members define an air space about the outer periphery of said glass unit.

14. The insulated door of claim 1 in which said barrier members are made of foam material.

15. The insulated door of claim 1 in which said barrier members are made of structural cellular foam.

16. The insulated door of claim 1 in which said barrier members are made of plastic foam material having a relatively low density cellular core and a non-porous outer skin.

17. A refrigerator door assembly comprising a metal cabinet frame for mounting in a cabinet opening, an insulated glass door mounted for movement relative to said cabinet frame, said glass door comprising an insulated glass unit having a plurality of glass panes disposed in side-by-side relation, a metal spacer interposed between adjacent of said panes for maintaining said panes in parallel relation with an air space therebetween, means sealing said air space from the outside environment, an outer metal structural frame member about the periphery of said glass unit for supporting the weight of said glass unit, said outer structural frame member having a front wall disposed adjacent a front side of said glass unit and an outer side wall extending rearwardly thereof and encompassing substantially the outer periphery of said glass unit, and means formed of rigid non-metallic material engaged with said outer metal frame member in interposed relation between said outer metal frame member and said insulated glass unit for retaining the glass unit within the outer metal frame and for forming a thermal insulating barrier between the outer metal frame and the glass unit, and said barrier and retaining means including a pair of barrier members disposed in side by side relation adjacent the outer periphery of said glass unit, each said barrier member having a leg portion disposed on a respective side of said glass unit for engaging and positively retaining said glass unit.

18. The insulated door of claim 17 in which one of said barrier members includes means adapted for snap action positive engagement with said outer metal frame members.

19. The insulated door of claim 17 in which said outer metal frame member includes an inner side wall extending rearwardly of said front wall which together with said outer side wall defines a rearwardly opening channel, and one of said barrier members is formed with recesses for receiving and positively retaining the terminal ends of said rearwardly extending side walls.

20. The insulated door of claim 17 in which said barrier members are disposed in side-by-side relation adjacent the outer periphery of said glass unit, and at least one of said barrier members being adapted for snap action engagement with said outer metal frame member.

21. The insulated door of claim 17 in which said barrier members are made of molded, expanded, or extruded foam material.

22. The insulated door of claim 17 in which said barrier members are made of plastic foam material having a relatively low density cellular core and a non-porous outer skin.

23. An insulated door comprising a glass unit having a plurality of glass panes disposed in side-by-side relation, a spacer interposed between adjacent of said panes for maintaining said panes in parallel relation with an air space therebetween, and means sealing said air space from the outer side environment, an outer metal frame about the periphery of said glass unit, said outer metal frame having a front wall disposed adjacent a front side of said glass unit and outer and inner side walls which extend rearwardly of said front wall for defining a rearwardly opening channel, said inner side wall and front wall further defining an inwardly opening channel, and means formed of rigid non-metallic material interposed between the outer metal frame and said insulated glass unit for retaining the glass unit within the outer metal frame and for forming a thermal insulating barrier therebetween, said retaining and barrier means including means engagable in said rearwardly and inwardly opening channels.

24. An insulated door comprising a glass unit having a plurality of glass panes disposed in side-by-side relation, a spacer interposed between adjacent of said panes for maintaining said panes in parallel relation with an air space therebetween, and means sealing said air space from the outer side environment, an outer metal frame about the periphery of said glass unit, means formed of rigid non-metallic material interposed between the outer metal frame and said insulated glass unit for retaining the glass unit within the outer metal frame and for forming a thermal insulating barrier therebetween, said retaining and barrier means including a pair of barrier members disposed in side-by-side relation adjacent the outer periphery of said glass unit, and one of said barrier members being mounted adjacent a front side of said glass unit and the other said barrier member being mounted adjacent the rear side of said glass unit, and each of said barrier members having a leg portion disposed on a respective side of said glass unit, and means fixedly securing one of said barrier members to said outer metal frame, and the other of said barrier members being adapted for snap action engagement with said outer metal frame.

* * * * *